US005466395A

United States Patent [19]

Tosaka et al.

[11] Patent Number: 5,466,395

[45] Date of Patent: Nov. 14, 1995

[54] LIQUID DETERGENT COMPOSITION

[75] Inventors: Masaki Tosaka, Oyama; Hiroyuki Saijo; Haruki Kawano, both of Utsunomiya; Yutaka Hayakawa, Kawachimachi; Toshiaki Ohi, Ichikaimachi, all of Japan

[73] Assignee: Kao Corporation, Tokyo, Japan

[21] Appl. No.: 269,900

[22] Filed: Jul. 6, 1994

Related U.S. Application Data

[63] Continuation of Ser. No. 953,876, Sep. 30, 1992, abandoned.

[30] Foreign Application Priority Data

| | | | |
|---|---|---|---|
| Oct. 3, 1991 | [JP] | Japan | 3-256700 |
| Oct. 3, 1991 | [JP] | Japan | 3-256703 |
| Oct. 24, 1991 | [JP] | Japan | 3-277538 |

[51] Int. Cl.[6] ..... C11D 1/29; C11D 3/20; C11D 3/22

[52] U.S. Cl. ..... 252/551; 252/121; 252/174.22; 252/174.18; 252/174.23

[58] Field of Search ..... 252/551, DIG. 13, 252/174.2374.18, 121

[56] References Cited

U.S. PATENT DOCUMENTS

| | | | |
|---|---|---|---|
| 4,728,457 | 3/1988 | Fieler et al. | 252/174.15 |
| 4,788,006 | 11/1988 | Bolich, Jr. et al. | 252/550 |
| 4,842,850 | 6/1989 | Vu | 424/70 |
| 4,902,499 | 2/1990 | Bolish, Jr. et al. | 424/70 |
| 4,906,459 | 3/1990 | Cobb et al. | 424/70 |
| 5,025,069 | 6/1991 | Deguchi et al. . | |

FOREIGN PATENT DOCUMENTS

| | | |
|---|---|---|
| 0116171 | 8/1984 | European Pat. Off. . |
| 0133345 | 2/1985 | European Pat. Off. . |
| 0167382 | 1/1986 | European Pat. Off. . |
| 0332805 | 9/1989 | European Pat. Off. . |
| 2114996 | 9/1983 | United Kingdom . |
| 2121072 | 12/1983 | United Kingdom . |
| 2205578 | 12/1988 | United Kingdom . |
| 2226045 | 6/1990 | United Kingdom . |

*Primary Examiner*—Paul Lieberman
*Assistant Examiner*—Erin M. Harriman
*Attorney, Agent, or Firm*—Oblon, Spivak, McClelland, Maier & Neustadt

[57] ABSTRACT

This invention provides a liquid detergent composition comprising (A) a surface active agent, (B) a pearlescent agent, and (C) a viscosity modifier, which exhibits an opaque appearance and has a viscosity of 200–4,000 cps at 20° C. bulk temperature and a Brookfield yield value of 5–100 p. This detergent composition can be squeezed from a container at a constant volume and can be perceived visually when applied onto a sponge without being soaked quickly into it so that it is not only economical since it prevents excess usage but also helps to prevent chapped hands or skin roughening.

5 Claims, No Drawings

LIQUID DETERGENT COMPOSITION

This application is a Continuation of application Ser. No. 07/953,876, filed on Sep. 30, 1992, now abandoned.

BACKGROUND OF THE INVENTION

1. Field of the Invention

The present invention relates to a novel detergent composition, and, more particularly, to an economical detergent composition for kitchen use which, when applied to a sponge, can be retained on the surface of the sponge without being soaked quickly into it, and which can avoid the excess use as the squeezed amount is visualized by its opaque appearance.

2. Description of the Background Art

Dish washing detergents are usually used either by preparing a diluted solution in a sink or a pail in which tableware is washed, or by applying the neat liquid directly to a sponge and washing tableware with it. Of these, the latter method is more often used.

Most of the conventional dish washing detergents have a drawback in that the volume to be squeezed from the container cannot be easily perceived visually because they are transparent in appearance.

On the other hand, there are some dish washing detergents which are opaque. However, the viscosity of these detergents is usually adjusted to a relatively low grade to facilitate easy squeezeing. This also brings about the difficulty of perceiving the squeezed amount visually when the detergent liquid is directly applied on a sponge because the detergent liquid soaks immediately into the sponge.

Due to the difficulty in perceiving the squeezed amount visually, as stated above, the conventional liquid detergents has been known difficult to control its amount to be used. This often leads to excess use of detergents, which is not only uneconomical but is sometimes considered to be a cause of chapped hands.

An object of the present invention is, therefore, to provide a liquid detergent composition of which the squeezed amount can be easily perceived visually and the amount to be used can be constantly controlled.

In view of this situation, the present inventors have undertaken extensive studies on the appearance of liquid detergents and properties of detergents upon squeezing from their containers. As a result, the present inventors have found that an opaque detergent, which can always be squeezed from a container at a constant amount and is visually perceivable on a sponge without being soaked quickly into it and is easily squeezed from the container, can be obtained by incorporating a pearlescent agent and by controlling not only the viscosity but also the Brookfield yield value of the composition within a certain range. These findings have led to the completion of the present invention.

SUMMARY OF THE INVENTION

Accordingly, an object of the present invention is to provide a liquid detergent composition, which exhibits an opaque appearance and has a viscosity of 200–4,000 cps at 20° C. bulk temperature and a Brookfield yield value of 5–100 p, comprising (A) a surface active agent, (B) a pearlescent agent, and (C) a viscosity modifier.

In a preferred embodiment, the composition comprises (A) 1–40% by weight of a surface active agent, (B) 0.5–20% by weight of a pearlescent agent, and (C) 0.1–10% by weight of a viscosity modifier, wherein the B/A ratio is in a range of 0.05–1.

Other objects, features and advantages of the invention will hereinafter become more readily apparent from the following description.

DETAILED DESCRIPTION OF THE INVENTION AND PREFERRED EMBODIMENTS

There are no particular limitations as to the surface active agents (A) to be used in the composition of the present invention. Any anionic, nonionic or amphoteric surface active agents can be used.

Given as preferable anionic surface active agents are polyoxyethylene (average added moles: 1–7) alkyl or alkenyl ($C_8$–$C_{18}$) ether sulfates, linear alkyl or alkenyl ($C_8$–$C_{18}$) benzene sulfonates, salts of α-sulfo-fatty acid esters ($C_8$–$C_{18}$), α-olefin ($C_8$–$C_{18}$) sulfonates, alkane ($C_8$–$C_{18}$) sulfonates, alkyl or alkenyl ($C_8$–$C_{18}$) sulfates, monoalkyl or alkenyl ($C_8$–$C_{18}$) phosphates, and the like. Salts of alkali metal, alkaline earth metal, ammonium salts, alkanolamine salts, and the like can be included.

Of these anionic surface active agents, particularly preferred are polyoxyethylene alkyl or alkenyl ether sulfates represented by formula (I):

$$R^1O(CH_2CH_2O)_lSO_3M \qquad (I)$$

wherein $R^1$ represents an alkyl or an alkenyl group of $C_8$–$C_{18}$, 1 is an integer of 1–7 as the average added moles, M denotes an alkali metal, alkaline earth metal, ammonium or alkanolamine.

Specific examples of the alkyl group for $R^1$ in the above formula (I) are octyl, nonyl, decyl, undecyl, dodecyl, tridecyl, tetradecyl, pentadecyl, hexadecyl, heptadecyl, octadecyl, and the like; those of the alkenyl group are octenyl, nonenyl, decenyl, dodecenyl, undecenyl, tridecenyl, tetradecenyl, pentadecenyl, hexadecenyl, heptadecenyl, octadecenyl, and the like.

Preferable nonionic surface active agents are polyoxyalkylene (average added moles: 3–30) alkyl or alkenyl ($C_8$–$C_{18}$) ethers, polyoxyalkylene (average added moles: 3–30) alkyl or alkenyl ($C_8$–$C_{18}$) phenyl ethers, polyoxyethylene (average added moles: 3–30) polyoxypropylene (average added moles: 1–20) alkyl or alkenyl ($C_8$–$C_{18}$) ethers, polyoxyalkylene (average added moles: 3–30) sorbitan fatty acid ($C_8$–$C_{18}$) esters, polyoxyalkylene (average added moles: 3–60) sorbitol fatty acid ($C_8$–$C_{18}$) esters, fatty acid ($C_8$–$C_{18}$) dialkanolamides, and the like.

Given as examples of amphoteric surface active agents are tertiary amineoxides which contains a $C_8$–$C_{18}$ alkyl or alkenyl group, carbobetaines containing a $C_8$–$C_{18}$ alkyl or alkenyl group, sulfobetaines containing a $C_8$–$C_{18}$ alkyl or alkenyl group, imidazoliniumbetaines containing a $C_8$–$C_{18}$ alkyl or alkenyl group, and the like.

Of these nonionic or amphoteric surface active agents, particularly preferred are those represented by the following formulas (II)–(X):

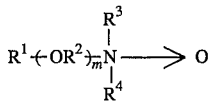

(II)

-continued $$R^1-O(CH_2CH_2O)_n-H \quad (III)$$

$$R^1-O(CH_2\underset{\underset{CH_3}{|}}{C}HO)_p-(CH_2CH_2O)_q-H \quad (IV)$$

$$R^1-O(CH_2CH_2O)_r-(CH_2\underset{\underset{CH_3}{|}}{C}HO)_s-H \quad (V)$$

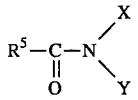

(VI)

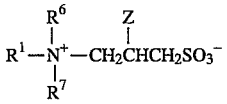

(VII)

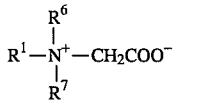

(VIII)

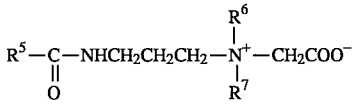

(IX)

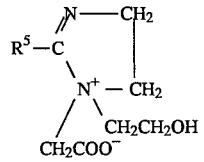

(X)

In the above formulas, $R^1$ is an alkyl or alkenyl group having 8–18 carbon atoms; $R^2$ is an alkylene group having 2–3 carbon atoms; $R^3$ and $R^4$, which may be the same or different, denote an alkyl group having 1–3 carbon atoms or a group $-(R^2O)_lH$, wherein l is a number 1–7 and $R^2$ is the same as above; $R^5$ is an alkyl or alkenyl group having 7–17 carbon atoms; $R^6$ and $R^7$, which may be the same or different, denote methyl or ethyl group; X is an alkanol group having 1–3 carbon atoms, Y is an alkanol group having 1–3 carbon atoms or a hydrogen atom, Z is a hydroxy group or a hydrogen atom, m is an average number of addition moles between 0–30, n is an average number of addition moles between 3–20, p and s are average numbers of addition moles and individually a number between 1–20, and q and r are average numbers of addition moles and individually a number between 3–30.

In the liquid detergent composition of the present invention, these surface active agents can be incorporated individually or in combination of two or more in an amount of 1–40% by weight, preferably 10–40% by weight, or most preferably 15–35% by weight. When the amount to be incorporated is less than 1% by weight, the composition exhibits little fundamental detergency and foaming capability. On the other hand, if the amount exceeds 40% by weight, it is undesirable because 1) the viscosity of liquid detergents will be greatly increased, and 2) the stability of solutions will be impaired.

Among these surface active agents, the anionic surface active agent serves as the principal and active component for detergency in the composition of the present invention, and its amount to be incorporated into the composition is preferably 5–30% by weight, with a particularly preferable range being 10–20% by weight, in total. If the amount is less than 5%, the detergency and foaming capability will be insufficient. An amount exceeding 30% by weight is also undesirable either because the viscosity of the composition will be greatly increased, resulting in difficulty of squeezing out it of its containers or the stability of the solution will be impaired.

On the other hand, nonionic and amphoteric surface active agents, when used in conjunction with anionic surface active agents, are able to enhance the detergency against oily soils and to ease the activity to the skin, thereby preventing chapped hands or skin roughening. These nonionic and amphoteric surface active agents can be incorporated individually or in combination of two or more in an amount of 1–10% by weight, more preferably 2–5% by weight, to the total composition. If the amount is less than 1% by weight, sufficient effects cannot be obtained, while an amount exceeding 30% by weight is also undesirable for the reasons that the viscosity of the composition will be greatly increased or the stability of the solution will be impaired.

The pearlescent agent (B) used in the composition of the present invention is a water-insoluble compound having a melting point of 30° C. or higher. In particular, those defined in formulas (B-I), (B-II) and (B-III) are preferable.

(B-I) A compound having the structure of formula (XI) and possessing a melting point of 30° C. or higher:

$$R^5-CO-(-OCH_2CH_2-)_t-OA \quad (XI)$$

wherein $R^5$ represents an alkyl or an alkenyl group of $C_{15}$–$C_{23}$, A denotes an aliphatic acyl group of $C_{16}$–$C_{24}$ or a hydrogen atom, and t is an integer of 1–3.

(B-II) A compound having the structure of formula (XII) and possessing a melting point of 30° C. or higher:

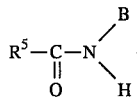

(XII)

wherein B represents a group $-CH_2CH_2OH$, $-CH_2CH(CH_3)OH$, or $-CH_2CH_2CH_2OH$, and $R^5$ has the same meaning as defined above.

(B-III) A partial ester derived from a hydroxyl group-containing compound selected from the group consisting of glycerol, polyglycerol (condensation degree: 2–10), sorbitol, pentaerythritol, glucose, fructose, maltose and sucrose; and a long chain saturated fatty acid of $C_{16}$–$C_{24}$; and having a melting point of 30° C. or higher.

Given as examples of (B-I) are ethylene glycol monostearic acid ester, ethylene glycol distearic acid ester, diethylene glycol monostearic acid ester, diethylene glycol distearic acid ester, and the like. Given as examples of (B-II) are stearic acid monoethanolamide, behenic acid monoethanolamide, hydrogenated beef tallow fatty acid monoethanolamide, hydrogenated palm oil fatty acid monoethanolamide, and the like. Given as preferable examples of (B-III) are partial esters of glycerol and a long chain fatty acid: particularly preferred are those having a $C_{16}$–$C_{24}$ content in the residue group of fatty acid and containing 75% or more of monoglyceride. Such glycerol fatty acid esters include esters of glycerol and a long chain fatty acid such as stearic acid, behenic acid, hydrogenated lard fatty acid, hydrogenated rape-seed oil fatty acid, hydrogenated palm oil fatty acid, and the like.

Although the amount of the pearlescent agent (B) to be incorporated into the composition is not specifically limited so long as it makes the detergent composition opaque and can control the viscosity and the Brookfield yield value of the composition to the ranges specified previously, 0.5–20% by weight is preferable, with the most preferable range being 1–10% by weight. If the amount of the pearlescent agent is less than 0.5% by weight, the opacity will be insufficient, while more than 20% by weight is not favorable because it will worsen the stability of the solution.

These pearlescent agents (B) can be used individually or in combination of two or more. When (B-I) or (B-II) is used together with (B-III), the dispersion stability of the pearlescent agents will be improved so that the pearlescent agents can retain a homogeneous dispersion without causing separation or precipitation even after a long period of time. In order to secure an improved dispersion, the weight ratio of pearlescent agents [(B-I) or (B-II)]/(B-III) is desirably in the range of 0.1–1.0. For the formulation of these detergent compositions in which different kinds of pearlescent agents are used together, it is desirable that the amount of component (B-I) or (B-II) be 0.5–10% by weight, preferably 1–5% by weight, while the amount of component (B-III) be 1–20% by weight, preferably 3–10% by weight to the total composition.

It is essential that the appearance of the liquid detergent composition of the present invention be opaque. The desired opacity is less than 1% in the percent transmission of visible light at 420 nm, at optical length 1 cm and bulk temperature at 20° C.

It is also essential that the viscosity of the liquid detergent composition of the present invention be in a range of 200–4,000 cps at 20° C. bulk temperature; and the Brookfield yield value be in a range of 5–100 p. The preferable viscosity range is 200–1,000 cps and the preferable Brookfield yield value is 5–50 p. If both the viscosity and Brookfield yield value are too low, the detergent will quickly soak into a sponge when squeezed onto it, and the squeezed volume cannot be perceived visually. If the viscosity and the Brookfield yield value are too high, it is undesirable because it becomes difficult to squeeze out the detergent from a container.

In order to obtain appropriate viscosity and Brookfield yield values, the weight ratio of component (B) to component (A) [(B)/(A)] is preferably in a range of 0.05–1.

Viscosity modifiers (C) used in the present invention include viscosity increasing agents such as partially bridged polyacrylic acid, hydroxyethyl cellulose, carboxymethyl cellulose, xanthane gum, montmorillonite, hectorite, saponite, vermiculite, nontronite, sauconite, laponite, and the like; and viscosity decreasing agents such as ethanol, propanol, isopropanol, ethylene glycol, propylene glycol, glycerol, polyglycerol (condensation degree: 2–10), sorbitol, pentaerythritol, benzene sulfonate, lower alkyl ($C_1$–$C_4$) benzene sulfonate, and the like. These viscosity modifiers are incorporated into the liquid detergent composition of the present invention in an amount of 0.1–10% by weight, preferably 0.1–8% by weight.

In addition to components (A), (B) and (C), if component (D), which is a polyalkyleneoxide adduct to polyalcohol having an average molecular weight of 300–4,000 or its salt, is incorporated in the composition, liquid detergent compositions with beautiful pearlescent gloss or milky-white appearance can be obtained while retaining abundant lathering, homogeneous dispersion and preventing separation and precipitation during and after a long storage. Given as examples of component (D) are polyoxyethylene oxide or polypropylene oxide adduct to ethylene glycol or glycerol; and sulfate esters or phosphate esters thereof. As salts, alkali metal salts, alkaline earth metal salts, ammonium salts, alkanolamine salts are preferable. Component (D) is incorporated in the composition in an amount of 1–10% by weight, preferably 1–5% by weight to the total composition.

Besides the above components, other components can optionally be added to the composition of the present invention as required so long as they do not impair the intended effects. Such optional components include, for example, perfumes, dyestuff, pigments, preservatives, antiseptics, pH adjusting agents, and the like.

The detergent composition of the present invention can be prepared according to a conventional method by mixing and churning the above-described components under room temperature or with heating, and adjusting the values of viscosity and Brookfield yield.

The detergent compositions thus obtained are appropriate for kitchen and household use such as for washing tableware, kitchen utensils, bath room, flooring, wall, glass, furniture, toilet, vegetable, fruit, or the like.

The detergent composition of the present invention can be visually perceived when applied on a sponge without being soaked quickly into it. It can easily be squeezed out from a container at a constant amount so that it is not only economical in avoiding excess usage but also helps to prevent chapped hands or skin roughening.

Other features of the invention will become apparent in the course of the following description of the exemplary embodiments which are given for illustration of the invention and are not intended to be limiting thereof.

EXAMPLES

The following test methods were used in Examples:

(1) Opacity

Test samples were filled in a 1-cm glass cell and the transmission percentage at 420 nm were measured by double-beam spectrophotometer using deionized water as a control.

(2) Viscosity

Test samples were charged in beakers for viscosity measurement and kept at 20° C. in a thermostat water bath. The viscosity was measured by BM type viscometer using a No. 3 rotor operating at 60 rpm, except a No. 4 rotor was used when the viscosity exceeded 2,000 cps.

(3) Brookfield Yield Values

Test samples were charged in beakers for viscosity measurement and kept at 20° C. in a thermostat water bath. Using a B8H type viscometer, the apparent viscosities at 0.5 rpm (No. 3 rotor) and 1 rpm (No. 3 rotor) were measured for each sample. The Brookfield yield values were calculated by the following equation:

$$\text{Brookfield Yield Value} = \frac{\left[\begin{array}{c}\text{Apparent viscosity}\\ \text{at 0.5 rpm; Rotor No. 3,}\\ \text{B8H Viscometer}\end{array}\right] - \left[\begin{array}{c}\text{Apparent viscosity}\\ \text{at 1 rpm; Rotor No. 3,}\\ \text{B8H Viscometer}\end{array}\right]}{100}$$

(4) Squeezability and Visibility

The test sample was poured into a commercial bottle for kitchen detergent use (350 ml, equipped with a push-pull cap) and about 5 g of the sample was squeezed onto a sponge (commercially available, polyurethane foam). Squeezability (ease of squeezing the sample liquid from the bottle) and visibility of the liquid volume on the sponge were evaluated according to the following criteria:

Squeezability

AAA: Easy to squeeze.

CCC: Difficult to squeeze.

Visibility

AAA: The liquid volume is clearly perceived.

CCC: The liquid soaks into the sponge quickly and the volume cannot be identified.

(5) Weighability 350 g of test samples were poured into commercial bottles for kitchen detergent use (350 ml, equipped with a push-pull cap). About 20 g of the neat liquids of the samples was squeezed three times from the bottles on sponges by 10 house wives. Scattering of the squeezed amount of each sample was examined.

Example 1

The detergent compositions listed in Table 1 were prepared and evaluated relative to the above-described characteristics (1)–(5). The results are shown in Table 1.

TABLE 1

| | Comparative Composition | | Invention Composition | | | |
|---|---|---|---|---|---|---|
| Component (wt %) | 1 | 2 | 1 | 2 | 3 | 4 |
| Component (A) | | | | | | |
| Sodium polyoxyethylene (4) dodecyl ether sulfate | 20 | 20 | 20 | 20 | 20 | 20 |
| Dodecyldimethylamine oxide | 5 | 5 | 5 | 5 | 5 | 5 |
| Component (B) | | | | | | |
| Stearic acid monoglyceride | — | 10 | 10 | 10 | 10 | 10 |
| Component (C) | | | | | | |
| Ethanol | — | — | 5 | — | — | — |
| Ethylene glycol | — | — | — | 5 | — | — |
| Propylene glycol | — | — | — | — | 10 | — |
| Sodium p-toluene sulfonate | — | — | — | — | — | 5 |
| Other | | | | | | |
| Water | Balance | | Balance | | | |
| Transmission percentage (%) | 100 | 0 | 0 | 0 | 0 | 0 |
| Viscosity (cps) | 800 | 4500 | 2000 | 1850 | 1500 | 1500 |
| Brookfield yield value (p) | 0 | 110 | 40 | 25 | 20 | 25 |
| Squeezability | AAA | CCC | AAA | AAA | AAA | AAA |
| Visibility | CCC | AAA | AAA | AAA | AAA | AAA |
| Weighability (g) | 30 ± 5.0 | 25 ± 4.0 | 20 ± 0.5 | 19 ± 1.0 | 20 ± 0.5 | 21 ± 0.5 |

Example 2

The detergent compositions listed in Table 2 were prepared and evaluated relative to the above-described characteristics (1)–(5). The results are shown in Table 2.

TABLE

| | Comparative Composition | | | Invention Composition | | |
|---|---|---|---|---|---|---|
| Component (%) | 3 | 4 | 5 | 5 | 6 | 7 |
| Component (A) | | | | | | |
| Sodium linear alkyl benzene sulfonate (Average M.W. = 344) | 5 | 5 | 5 | 5 | 5 | 5 |
| Sodium polyoxyethylene (3) dodecyl ether sulfate | 10 | 10 | 10 | 10 | 10 | 10 |

As is evident from Examples 1–2, only in the cases where the appearance is opaque and the values of viscosity and Brookfield yield fall within the ranges specified in this invention, can all of the evaluation characteristics (1)–(5) be satisfied.

TABLE-continued

| | Comparative Composition | | | Invention Composition | | |
|---|---|---|---|---|---|---|
| Component (%) | 3 | 4 | 5 | 5 | 6 | 7 |
| Lauric acid diethanolamide | 2 | 2 | 2 | 2 | 2 | 2 |
| Component (B) | | | | | | |
| Ethylene glycol monostearate | — | 0.5 | — | 0.5 | — | — |
| Stearic acid monoethanolamide | — | — | 1 | — | 1 | 1 |
| Component (C) | | | | | | |
| Montmorillonite *1 | — | — | — | 1 | — | — |
| Hydroxyethyl cellulose *2 | — | — | — | — | 0.5 | — |
| Hectorite *3 | — | — | — | — | — | 1 |
| Other | | | | | | |
| Water | | Balance | | | Balance | |
| Transmission percentage (%) | 100 | 0 | 0 | 0 | 0 | 0 |
| Viscosity (cps) | 95 | 100 | 120 | 800 | 1500 | 2500 |
| Brookfield yield value (p) | 0 | 0 | 0 | 15 | 30 | 48 |
| Squeezability | AAA | AAA | AAA | AAA | AAA | AAA |
| Visibility | CCC | CCC | CCC | AAA | AAA | AAA |
| Weighability (g) | 30 ± 5.0 | 30 ± 4.0 | 27 ± 4.0 | 20 ± 0.5 | 19 ± 1.0 | 21 ± 0.5 |

*1: Kunipia: Trade Mark, manufactured by Kunimine Industry Co.
*2: Hydroxyethyl cellulose (SE-850K): Trade Mark, manufactured by Daicel Co.
*3: VEEGUM T: Trade Mark, manufactured by R. T. Vanderbil Co.

Example 3

The detergent compositions listed in Table 3 were prepared. The appearance immediately following the preparation and the storage stability of each composition were examined by the following methods. Each composition was prepared by mixing Components (A) and Other Components in Table 3 and heating to 80° C. Components (B) and (C) were then dissolved, and the mixture was cooled down to 30° C. over 2 hours while stirring. The results are shown in Table 3.

All of the Invention Compositions in Table 3 satisfied the prerequisite conditions of the present invention; i.e., opaque in appearance, viscosity at 20° C. bulk temperature in the range of 200–4,000 cps, and the Brookfield yield values in the range of 5–100 p.

(1) Observation of appearance

Test samples were poured into in a 100 ml transparent glass bottle and the appearance (pearlescent gloss) was observed with the naked eye. Samples in which bubbles were entrapped were subjected to centrifuging for degasing. The following evaluation standards were applied.

AAA: Uniform pearlescent gloss is observed.

BBB: Pearlescent gloss is not uniform, and a separated layer (transparent or emulsion-like) is observed or some precipitation is found at the bottom.

CCC: No pearlescent gloss is observed. Looks like a transparent solution or has an emulsion-like appearance.

(2) Storage stability

Test samples were poured into a 100-ml transparent glass bottle and placed in thermostat baths at −5° C., room temperature, 30° C. and 40° C., and stored for one month under those conditions. After the storage, the appearance of each sample was rated according to the evaluation standards described in (1) above.

Example 4

Detergent compositions listed in Table 4 were prepared and evaluated in the same manner as in Example 3. All of the Invention Compositions in Table 4 satisfied the prerequisite conditions of the present invention; i.e., opaque in appearance, viscosity at 20° C. bulk temperature in the range of 200–4,000 cps, and Brookfield yield values in the range of 5–100 p.

TABLE 3

| | Invention Composition | | |
|---|---|---|---|
| Component (wt %) | 8 | 9 | 10 |
| Component (A) | | | |
| Sodium polyoxyethylene (3) laurylether sulfate | 20 | — | 10 |
| Sodium linear alkyl benzene sulfonate (M.W. = 344) | — | 18 | — |
| Lauric acid diethanolamide | — | 4 | 8 |
| Polyoxyethylene (12) laurylether | — | 2 | — |
| Lauryldimethylamine oxide | 5 | — | — |
| Component (B) | | | |
| Ethylene glycol distearic acid ester | 2 | — | 2 |
| Stearic acid monoethanolamide | — | 3 | — |
| Glycerol stearic acid ester (Content of monoglyceride = 90%) | 5 | 5 | 8 |
| Component (C) | | | |
| Ethanol | 5 | 5 | 5 |
| Other component | | | |
| Deionized water | | Balance | |
| Appearance right after preparation | AAA | AAA | AAA |
| Storage stability | | | |
| at −5° C. | AAA | AAA | AAA |
| at room temperature | AAA | AAA | AAA |
| at 30° C. | AAA | AAA | AAA |
| at 40° C. | AAA | AAA | AAA |

TABLE 4

| Component (wt %) | | Invention Composition 11 | 12 | 13 |
|---|---|---|---|---|
| Component (A) | | | | |
| Polyoxyethylene (4) laurylether sulfate triethanolamine | | 10 | 10 | 10 |
| Palm oil fatty acid diethanolamide | | 10 | 10 | 10 |
| Component (B) | | | | |
| Diethylene glycol distearic acid ester | | 5 | 5 | 5 |
| Carbon number in fatty acid residue group | Content of monoglyceride | | | |
| 12 | 90 wt % | — | 5 | — |
| 18 | 90 | — | — | 5 |
| 22 | 90 | 5 | — | — |
| Component (C) | | | | |
| Ethanol | | 5 | 5 | 5 |
| Other component | | | | |
| Deionized water | | | Balance | |
| Appearance right after preparation | | AAA | AAA | AAA |
| Storage stability | | | | |
| at −5° C. | | AAA | AAA | AAA |
| at room temperature | | AAA | AAA | AAA |
| at 30° C. | | AAA | AAA | AAA |
| at 40° C. | | AAA | AAA | AAA |

Example 5

The detergent compositions listed in Table 5 were prepared and detergency, lathering capability, feel upon use, and hand-chapping tendency were evaluated according to the methods described below. The results are shown in Table 5. All of the Invention Compositions in Table 5 satisfied the prerequisite conditions of the present invention; i.e., opaque in appearance, viscosity at bulk temperature 20° C. in the range of 200–4,000 cps, and Brookfield yield values in the range of 5–100 p.

(1) Lathering test 0.1% by weight of commercial butter was added as a soil component to detergent solutions of 0.5% by weight concentration (Hardness of water used: 3.5° DH) to measure the lathering capability of each composition. 40 ml of butter-contained detergent solution was poured into a glass cylinder having a 5 cm diameter and stirred for 15 minutes at 20° C. The lathering height immediately after ceasing stirring was measured.

(2) Detergency test 2.5 g of beef tallow, in which 0.1% by weight of Sudan III (red dye) was added as an indicator, was applied to porcelain dishes (diameter: 25 cm). The dishes were washed one by one at 20° C. by rubbing with a sponge in which 3 g of water and 27 g of a detergent solution were immersed. The washing procedure was repeated until the sponge could no longer clean the beef tallow on the dish. The number of cleansed dishes (effectively washed pieces) were taken as the score of detergency.

(3) Test for feel upon use

5% solutions of detergent compositions were prepared and kept at 30° C. Hands were dipped in the solution for 10 minutes and rinsed at 30° C. with water. Then, the hands were thoroughly wiped with a dry towel and left to stand for 5 minutes. The feeling of the hand skin was rated by the following evaluation standards.

AAA: Hand skin feels dewy.

CCC: Hand skin feels fairly taut.

(4) Irritation to the hand skin

5% solutions of detergent compositions were prepared and kept at 30° C. Hands were dipped in the solution for 20 minutes and rinsed thoroughly with water. This procedure was repeated for 3 continuous days. On the fourth day, the condition of the hand skin of five panelists was evaluated visually and rated as an average score for each composition using the following criteria:

Score 5: No roughening of the skin was observed.

Score 4: Slight roughening of the skin was observed.

Score 3: Roughening of the skin was observed.

Score 2: Roughening of the skin was rather serious.

Score 1: Serious roughening of the skin was observed.

TABLE 5

| Component (wt %) | Invention Composition 14 | 15 | 16 | 17 | 18 | Comparative Composition 6 |
|---|---|---|---|---|---|---|
| Component (A) | | | | | | |
| Sodium polyoxyethylene (3) dodecyl ether sulfate | 20 | — | — | 20 | 20 | 20 |
| Sodium linear alkyl benzene sulfonate (Average M.W. = 344) | — | 20 | — | — | — | — |
| Sodium α-sulfo fatty acid methyl ester (Average M.W. = 350) | — | — | 20 | — | — | — |
| Sodium α-olefin sulfonate (Average M.W. = 326) | — | — | — | 5 | — | — |
| Sodium alkane sulfonate | — | — | — | — | 5 | — |
| Polyoxyethylene (12) dodecyl ether | 3 | 3 | 3 | 3 | 3 | 3 |
| Component (B) | | | | | | |
| Glycerol stearic acid ester (content of monoglyceride = 95%) | 5 | 5 | 5 | 8 | 8 | — |
| Component (C) | | | | | | |
| Ethanol | 5 | 5 | 5 | 5 | 5 | 5 |

TABLE 5-continued

| Component (wt %) | Invention Composition 14 | 15 | 16 | 17 | 18 | Comparative Composition 6 |
|---|---|---|---|---|---|---|
| Other | | | | | | |
| Water | | | Balance | | | Balance |
| Detergency (pieces) | 6 | 6 | 6 | 6 | 7 | 4 |
| Lathering (mm) | 80 | 80 | 80 | 80 | 85 | 80 |
| Feel upon use | AAA | AAA | AAA | AAA | AAA | CCC |
| Irritation to hand skin | 5.0 | 5.0 | 5.0 | 5.0 | 4.5 | 3.5 |

Example 6

The detergent compositions listed in Table 6 were prepared and evaluated in the same manner as in Example 5. The results are shown in Table 6. All of the Invention Compositions in Table 6 satisfied the prerequisite conditions of the present invention; i.e., opaque in appearance, viscosity at 20° C. bulk temperature in the range of 200–4,000 cps, and Brookfield yield values in the range of 5–100 p.

TABLE 6

| Component (wt %) | | Invention Composition 19 | 20 |
|---|---|---|---|
| Component (A) | | | |
| Sodium linear alkyl benzene sulfonate (Average M.W. = 344) | | 20 | 20 |
| Dodecanoic acid diethanolamide | | 8 | 8 |
| Component (B) | | | |
| Carbon number in fatty acid residue group | Content of monoglyceride | | |
| 16 | 95 wt % | 8 | — |
| 22 | 90 | — | 8 |
| Component (C) | | | |
| Ethanol | | 5 | 5 |
| Other component | | | |
| Deionized water | | Balance | |
| Detergency (pieces) | | 6 | 6 |
| Lathering (mm) | | 90 | 90 |
| Feel upon use | | AAA | AAA |
| Irritation to hand skin | | 5.0 | 5.0 |

Example 7

Detergent compositions listed in Table 7 were prepared and evaluated in the same manner as in Example 5. The results are shown in Table 7. All of the Invention Compositions in Table 7 satisfied the prerequisite conditions of the present invention; i.e., opaque in appearance, viscosity at 20° C. bulk temperature in the range of 200–4,000 cps, and Brookfield yield values in the range of 5–100 p.

TABLE 7

| Component (wt %) | Invention Composition 21 | 22 | 23 | 24 | 25 | Comparative Composition 7 |
|---|---|---|---|---|---|---|
| Component (A) | | | | | | |
| Sodium polyoxyethylene (3) dodecyl ether sulfate | 15 | — | — | 15 | 15 | 15 |
| Sodium linear alkyl benzene sulfonate (Average M.W. = 344) | — | 15 | — | — | — | — |
| Sodium α-sulfo fatty acid methyl ester (Average M.W. = 350) | — | — | 15 | — | — | — |
| Sodium α-olefin sulfonate (Average M.W. = 326) | — | — | — | 5 | — | — |
| Sodium alkane sulfonate (Average M.W. = 356) | — | — | — | — | 5 | — |
| Dodecyldimethylamine oxide | 3 | 3 | 3 | 3 | 3 | 3 |
| Component (B) | | | | | | |
| Glycerol stearic acid ester (content of monoglyceride = 95%) | 5 | 5 | 5 | 8 | 8 | — |
| Component (C) | | | | | | |
| Ethanol | 5 | 5 | 5 | 5 | 5 | 5 |
| Other | | | | | | |
| Water | | | Balance | | | Balance |
| Detergency (pieces) | 6 | 6 | 6 | 6 | 7 | 4 |
| Lathering (mm) | 80 | 80 | 80 | 80 | 85 | 80 |
| Feel upon use | AAA | AAA | AAA | AAA | AAA | CCC |

TABLE 7-continued

| Component (wt %) | Invention Composition 21 | 22 | 23 | 24 | 25 | Comparative Composition 7 |
|---|---|---|---|---|---|---|
| Irritation to hand skin | 5.0 | 5.0 | 5.0 | 5.0 | 4.5 | 3.5 |

Example 8

The detergent compositions listed in Table 8 were prepared and evaluated in the same manner as in Example 5. The results are shown in Table 8. All of the Invention Compositions in Table 8 satisfied the prerequisite conditions of the present invention; i.e., opaque in appearance, viscosity at 20° C. bulk temperature in the range of 200–4,000 cps, and Brookfield yield values in the range of 5–100 p.

TABLE 8

| Component (wt %) | | Invention Composition 26 | 27 |
|---|---|---|---|
| Component (A) | | | |
| Sodium polyoxyethylene (2.5) dodecyl ether | | 20 | 20 |
| Tetradecyldimethyl amine oxide | | 5 | 5 |
| Component (B) | | | |
| Carbon number in fatty acid residue group | Content of monoglyceride | | |
| 16 | 95 wt % | 8 | — |
| 22 | 90 | — | 8 |
| Component (C) | | | |
| Ethanol | | 5 | 5 |
| Other component | | | |
| Deionized water | | Balance | |
| Detergency (pieces) | | 6 | 6 |
| Lathering (mm) | | 90 | 90 |
| Feel upon use | | AAA | AAA |
| Irritation to hand skin | | 5.0 | 5.0 |

Example 9

The detergent compositions listed in Table 9 were prepared. The appearance immediately following the preparation, the storage stability, and lathering capability of each composition were examined, and the results are presented in Table 9.

Preparation Method

Each composition was prepared by mixing Components (A), (D) and Other Components in Table 9 with heating, followed by dissolving Components (B) at 80° C. The mixture was cooled down to 30° C. over 2 hours while continuously being stirred.

Evaluation Method (1) Observation of appearance

Test samples were poured into a 100-ml transparent glass bottle and the appearance was observed with the naked eye.

AAA: Uniform pearlescent gloss is observed.

CCC: Pearlescent gloss is not uniform, and a separated layer (transparent or emulsion-like) is observed.

(2) Storage stability

Test samples were poured into a 100-ml transparent glass bottle and placed in thermostat baths at −5° C., 30° C. and 40° C., and stored for one month. After the storage, the appearance of each sample was rated according to the evaluation standards described in (1) above.

(3) Lathering 0.1% by weight of commercial butter was added as a soil component to detergent solutions of 0.5% by weight concentration (Hardness of water used: 3.5° DH) to measure the lathering capability of each composition. 40 ml of butter-contained detergent solution was poured into a glass cylinder having a 5 cm diameter. In addition, 20 rubber balls of 1 cm diameter were put into the cylinder to enhance the mechanical force necessary for lathering. The content was stirred for 15 minutes at 20° C. and the lathering height right was measured for evaluation immediately after the stirring was stopped.

All of the Invention Compositions in Table 9 satisfied the prerequisite conditions of the present invention; i.e., opaque in appearance, viscosity at 20° C. bulk temperature in the range of 200–4,000 cps, and Brookfield yield values in the range of 5–100 p.

TABLE 9

| Component (wt %) | Invention Composition 28 | 29 | 30 | 31 |
|---|---|---|---|---|
| Component (A) | | | | |
| Sodium polyoxyethylene (3) laurylether sulfate | 15 | 15 | 20 | 20 |
| Lauryldimethylamine oxide | 5 | 5 | 3 | 3 |
| Polyoxyethylene (8) lauryl ether | 3 | 2 | — | — |
| Lauric acid diethanolamide | — | 1 | 5 | 5 |
| Component (B) | | | | |
| Stearic acid monoethanolamide | 3 | — | 2 | 9 |
| Glycerol monobehenic acid ester | — | 5 | — | — |
| Component (C) | | | | |
| Ethanol | 5 | 5 | 5 | 5 |
| Component (D) | | | | |
| Polyethyleneoxide adduct to ethylene glycol (Average M.W. = 1000) | 4 | 4 | 4 | 4 |
| Other component | | | | |
| Deionized water | Balance | | | |
| Appearance right after preparation | AAA | AAA | AAA | AAA |
| Storage stability | | | | |
| at −5° C. | AAA | AAA | AAA | AAA |
| at 30° C. | AAA | AAA | AAA | AAA |
| at 40° C. | AAA | AAA | AAA | AAA |
| Lathering (mm) | 100 | 100 | 100 | 100 |

Example 10

The detergent compositions listed in Table 10 were prepared in the same manner as in Example 9. Also, the appearance immediately following the preparation, the storage stability and lathering capability of each composition were examined in the same manner as in Example 9. The results are shown in Table 11. All of the Invention Compositions in Table 11 satisfied the prerequisite conditions of the present invention; i.e., opaque in appearance, viscosity at 20° C. bulk temperature in the range of 200–4,000 cps, and Brookfield yield values in the range of 5–100 p.

Example 11

The detergent compositions listed in Table 12 were prepared and evaluated in the same manner as in Example 9. The results are shown in Table 12. All of the Invention Compositions in Table 12 satisfied the prerequisite conditions of the present invention; i.e., opaque in appearance, viscosity at 20° C. bulk temperature in the range of 200–4,000 cps, and Brookfield yield in the range of 5–100 p.

TABLE 10

| | |
|---|---|
| Component (A) | |
| Sodium polyoxyethylene (4) laurylether sulfate | 18% |
| Myristyldimethylamine oxide | 2 |
| Polyoxyethylene (12) alkylether | 4 |
| Laurylhydroxy sulfobetaine* | 2 |
| Component (B) | 3 |
| Ethylene glycol monostearate | |
| Component (C) | 5 |
| Ethanol | |
| Component (D) | See Table 11. |
| Polyalkyleneoxide adduct of polyalcohol | |
| Other component | Balance |
| Deionized water | |

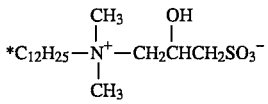

TABLE 11

| Component (wt %) | | Invention Composition | | | |
|---|---|---|---|---|---|
| | | 32 | 33 | 34 | 35 |
| Polyalkyleneoxide adduct to polyalcohol | Average M.W. | | | | |
| Polyethylenoxide | 1000 | 5 | — | — | — |
| adduct to glycerol | 2000 | — | 5 | — | |
| Polypropyleneoxide | 700 | — | — | 3 | — |
| adduct to ethylene glycol | 1500 | — | — | — | 3 |
| Appearance right after the preparation | | AAA | AAA | AAA | AAA |
| Storage stability | | | | | |
| at −5° C. | | AAA | AAA | AAA | AAA |
| at 30° C. | | AAA | AAA | AAA | AAA |
| at 40° C. | | AAA | AAA | AAA | AAA |
| Lathering (mm) | | 100 | 100 | 100 | 100 |

TABLE 12

| Component (wt %) | Invention Composition | | | |
|---|---|---|---|---|
| | 36 | 37 | 38 | 39 |
| Component (A) | | | | |
| Sodium polyoxyethylene (3) laurylether sulfate | 15 | 15 | 20 | 20 |
| Lauryldimethylamine oxide | 5 | 5 | 3 | 3 |
| Polyoxyethylene (8) lauryl ether | 3 | 2 | — | — |
| Lauric acid diethanolamide | — | 1 | 5 | 5 |
| Component (B) | | | | |
| Stearic acid monoethanolamide | 3 | — | 2 | 9 |
| Glycerol monobehenic acid ester | — | 5 | — | — |
| Component (C) | | | | |
| Ethanol | 5 | 5 | 5 | 5 |
| Component (D) | | | | |
| Polyethyleneoxide adduct to ethylene glycol (Average M.W. = 1500) | 4 | 4 | 4 | 4 |
| Other component | | | | |
| Deionized water | Balance | | | |
| Appearance right after preparation | AAA | AAA | AAA | AAA |
| Storage stability | | | | |
| at −5° C. | AAA | AAA | AAA | AAA |
| at 30° C. | AAA | AAA | AAA | AAA |
| at 40° C. | AAA | AAA | AAA | AAA |
| Lathering (mm) | 100 | 100 | 100 | 100 |

Example 12

The detergent compositions listed in Table 13 were prepared and evaluated in the same manner as in Example 9. The results are shown in Table 14. All of the Invention Compositions in Table 14 satisfied the prerequisite conditions of the present invention; i.e., opaque in appearance, viscosity at 20° C. bulk temperature in the range of 200–4,000 cps, and Brookfield yield values in the range of 5–100 p.

TABLE 13

| | |
|---|---|
| Component (A) | |
| Sodium polyoxyethylene (4) laurylether sulfate | 18% |
| Myristyldimethylamine oxide | 2 |
| Polyoxyethylene (12) alkylether | 4 |
| Laurylhydroxy sulfobetaine* | 2 |
| Component (B) | 3 |
| Ethylene glycol monostearate | |
| Component (C) | 5 |
| Ethanol | |
| Component (D) | See Table 14. |
| Sulfuric ester salt of polyalkyleneoxide adduct to polyalcohol | |
| Other component | Balance |
| Deionized water | |

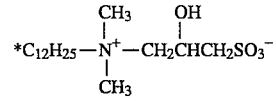

TABLE 14

| Component (wt %) | | Invention Composition 5 | 6 | 7 | 8 |
|---|---|---|---|---|---|
| Sulfuric ester salt of polyalkyleneoxide adduct to polyalcohol | Average M.W. | | | | |
| Trisodium trisulfuric ester of polyethylene-oxide to glycerol | 1000 | 5 | — | — | — |
| | 2000 | — | 5 | — | — |
| Disodium disulfuric ester of polypropyleneoxide adduct to ethylene glycol | 700 | — | — | 3 | — |
| | 1500 | — | — | — | 3 |
| Appearance right after preparation | | AAA | AAA | AAA | AAA |
| Storage stability | | | | | |
| at −5° C. | | AAA | AAA | AAA | AAA |
| at 30° C. | | AAA | AAA | AAA | AAA |
| at 40° C. | | AAA | AAA | AAA | AAA |
| Lathering (mm) | | 100 | 100 | 100 | 100 |

*Average molecular weight of polyalkylene oxide adduct to polyalcohol.

Obviously, numerous modifications and variations of the present invention are possible in light of the above teachings. It is therefore to be understood that within the scope of the appended claims, the invention may be practiced otherwise than as specifically described herein.

What is claimed is:

1. A liquid detergent composition comprising:

(A) a surface active agent wherein said surface active agent is a mixture of (i) an anionic surface active agent, and (ii) a nonionic surface active agent or an amphoteric surface active agent, wherein said anionic surface active agent is a compound represented by the following formula:

$$R^1O(CH_2CH_2O)_nSO_3M \quad (I)$$

wherein $R^1$ represents an alkyl or an alkenyl group of $C_{8-18}$, n has an average value of from 1 to 7, and M denotes an alkali metal, an alkaline earth metal, ammonium or alkanolamine, (B) 3–20% by weight of a pearlescent agent wherein said pearlescent agent is a partial ester of a glycerol and a $C_{16}$–$C_{24}$ fatty acid, and has a melting point of 30° C. or higher, and (C) 0.1–10% by weight of a viscosity modifier;

wherein the ratio (B)/(A) is in the range of from 0.05–1, wherein said liquid detergent composition exhibits an opaque appearance, and has a viscosity of 200–4000 cps at 20° C. and a Brookfield yield value of 5–100 p, said anionic surface active agent (i) is present in an amount of 5–30% by weight, and said nonionic or amphoteric surface active agent (ii) is present in an amount of 1–10% by weight.

2. The liquid detergent composition of claim 1, wherein said pearlescent agent is present in an amount of 5–20% by weight.

3. The liquid detergent composition of claim 1, wherein said pearlescent agent is present in an amount of from 3–10% by weight.

4. The liquid detergent composition of claim 1, wherein said pearlescent agent is present in an amount of from 5–10% by weight.

5. The liquid detergent composition of claim 1, wherein said liquid detergent composition further comprises a second pearlescent agent.

* * * * *